US008209898B2

(12) United States Patent
Long

(10) Patent No.: US 8,209,898 B2
(45) Date of Patent: Jul. 3, 2012

(54) SIGHT ACCESSORY

(76) Inventor: Timothy Fredrick Long, Gladwin, MI (US)

( * ) Notice: Subject to any disclaimer, the term of this patent is extended or adjusted under 35 U.S.C. 154(b) by 329 days.

(21) Appl. No.: 12/455,834

(22) Filed: Jun. 8, 2009

(65) Prior Publication Data

US 2010/0307047 A1 Dec. 9, 2010

(51) Int. Cl.
*F41G 1/38* (2006.01)

(52) U.S. Cl. ..... 42/143; 42/129

(58) Field of Classification Search ..... 42/129, 42/143; 351/45, 46, 47
See application file for complete search history.

(56) References Cited

U.S. PATENT DOCUMENTS 5,435,293 A 7/1995 Grimaldi
6,062,688 A * 5/2000 Vinas ..... 351/47
6,478,422 B1 * 11/2002 Hansen ..... 351/172
6,972,903 B2 * 12/2005 Hara et al. ..... 359/482
7,062,797 B2 * 6/2006 Khulusi ..... 2/431
2005/0012890 A1 * 1/2005 Iacobucci ..... 351/44
2010/0053542 A1 * 3/2010 Kitayama ..... 351/46

* cited by examiner

*Primary Examiner* — Stephen M Johnson

(74) *Attorney, Agent, or Firm* — Robert L. McKellar; McKellar IP Law, PLLC

(57) ABSTRACT

The instant invention is a sight accessory that attaches to a scope. The double vision blocker attaches with hook and loop fasteners and is further secured by a plurality of "O" rings. The blocker allows the user to sight with both eyes open preventing the occurrence of double vision. This creates an opportunity for the user to be more accurate on a consistent basis. The device is also suitable for use for both right handed and left handed users without any modification. The sight accessory can be attached to archery sights, scopes and any other instrument used for sighting.

11 Claims, 5 Drawing Sheets

SIGHT ACCESSORY

BACKGROUND OF THE INVENTION

The inventor is unaware of any pertinent prior art that is available. U.S. Pat. No. 5,435,293 issued to Grimaldi on Jul. 25, 1995 discloses a device that will encourage a shooter to develop binocular vision. The device of Grimaldi uses a plate that is placed between the shooter's eyes to limit the field of vision to one side of the plate or the other. This forces the shooter to use both eyes instead of using one dominate eye. The instant invention will block the vision in one eye allowing the user to leave both eyes open during the sighting phase of shooting. This blocking of the other eye or non-dominate eye prevents a condition of double vision from occurring. This is the essence of the invention, that is, the blocker prevents double vision by blocking the second eye from viewing the target but still allows that eye to be open.

THE INVENTION

An sight accessory comprising a blocker plate having a near end. There is an arcuate attachment means near the near end of the blocker plate for attachment to a sight. The sight has a long axis and the arcuate attachment means has an outside surface and an inside surface and said outside surface has a plurality of channels in it.

There is an additional fastening means comprised of elastomeric O-rings that are contained in at least two of the channels that also have the capability of wrapping around an outside surface of the sight such that the blocker plate is located vertical and perpendicular to a long axis of the sight.

DETAILED DESCRIPTION OF THE DRAWINGS

It is understood for the purposes of this patent application that the word sight encompasses sights that are circular in nature such as archery sights and scopes and any other sight that has a circular circumference used to sight targets.

The instant invention gathers its utility from the inherent problem that occurs when a person using one eye to sight, develops double vision from closing one eye to aid in looking through a sight. The sighting accessory allows the user to view through a sight with both eyes remaining open eliminating the development of double vision.

The sight accessory also garners utility in that it is completely adaptable to both right handed and left handed users without any modification whatsoever. The device is simply attached to the appropriate side of the sight depending on what hand sighting the user uses.

Figure 1:
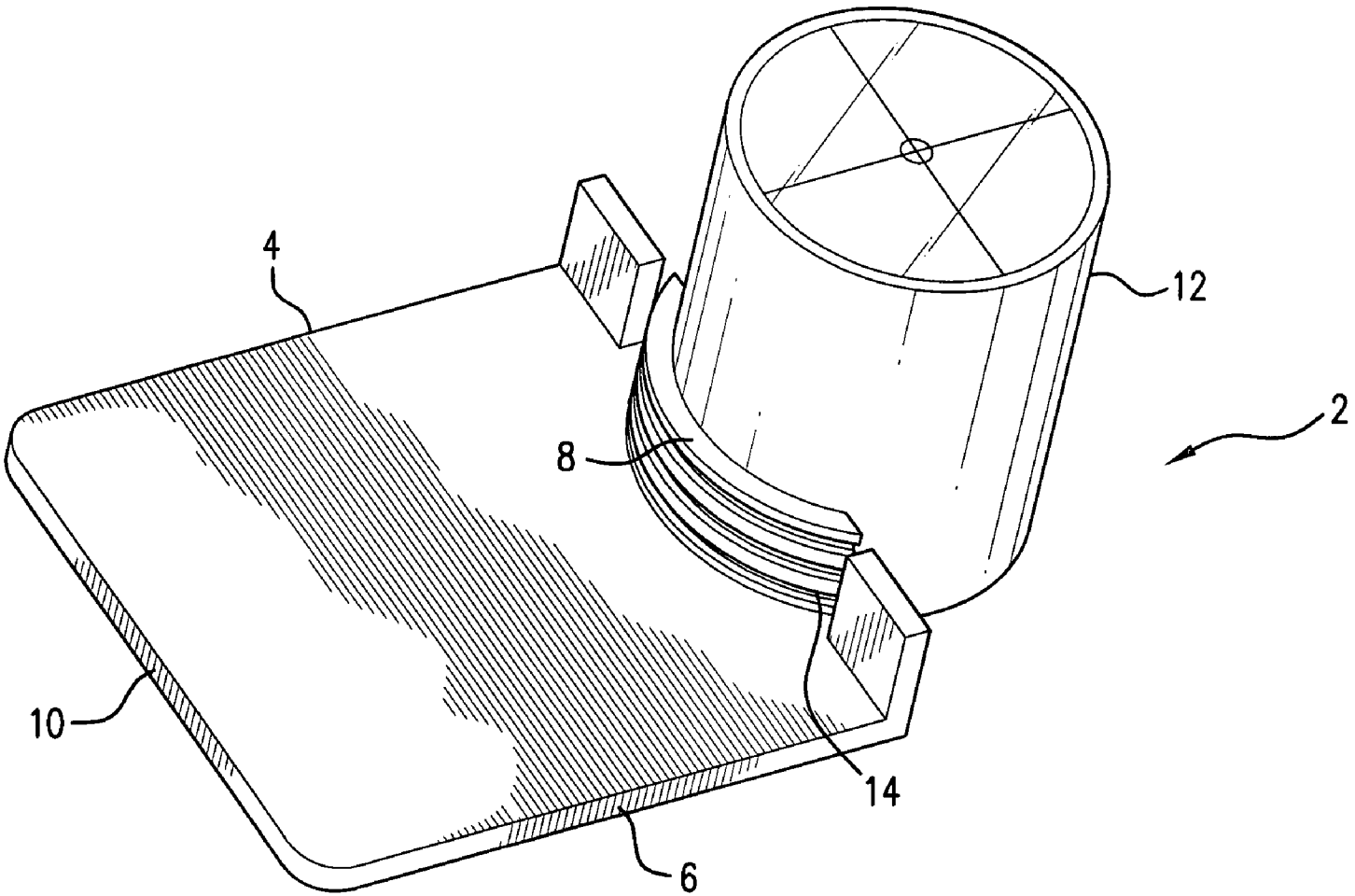
FIG. 1 is a perspective view of the sight accessory attached to a scope style sight.

FIG. 1 is a perspective view of the sight accessory 2 of this invention attached to a scope style sight 12. The blocker 2 attaches via the arcuate configuration 16 of the near end 8. Elastomeric O-rings 18, not shown, fit into the channels 14 and around the sight 12 securely attaching the blocker 2 to it. The blocker also consists of a top 4, a bottom 6 and a distal end 10. When the user peers through the sight 12 the user can leave both eyes open for the purpose of sighting without the chance of developing double vision because the non-sighting eye is blocked from the target, but the eye still remains open.

Figure 2:
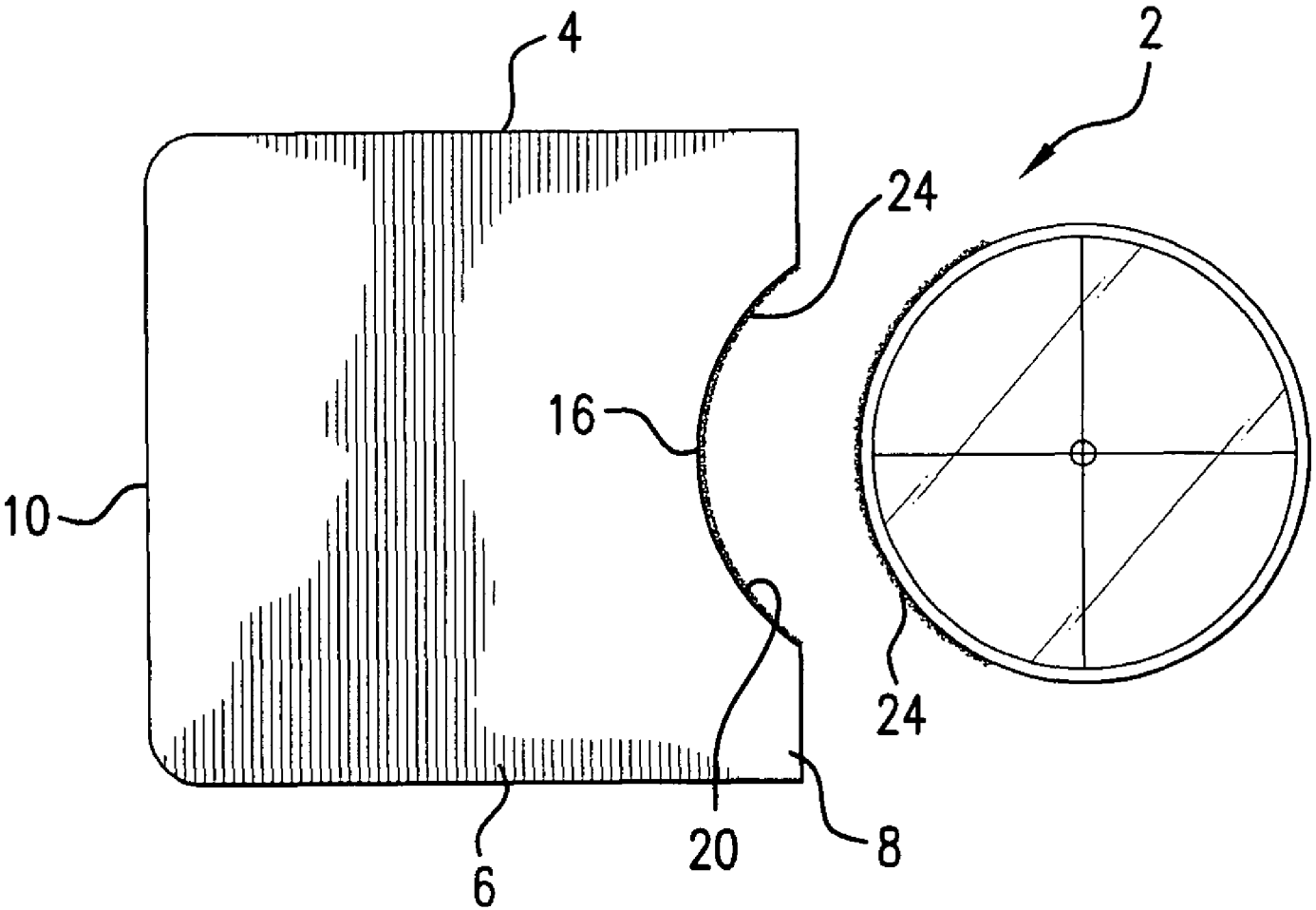
FIG. 2 is a front view of a blocker plate.

FIG. 2 is a frontal view of a blocker plate 2 showing the arcuate configuration 16. The inside surface 20 of the arcuate configuration 16 is lined with hook and loop fastener such as Velcro® 24. The sight 12 also has a strip of Velcro 24 attached thereto. The combination of the Velcro 24 meshing together for attachment, along with the O-rings secured within the channels 14 and around the sight 12 hold the blocker plate 2 in place.

Figure 3:
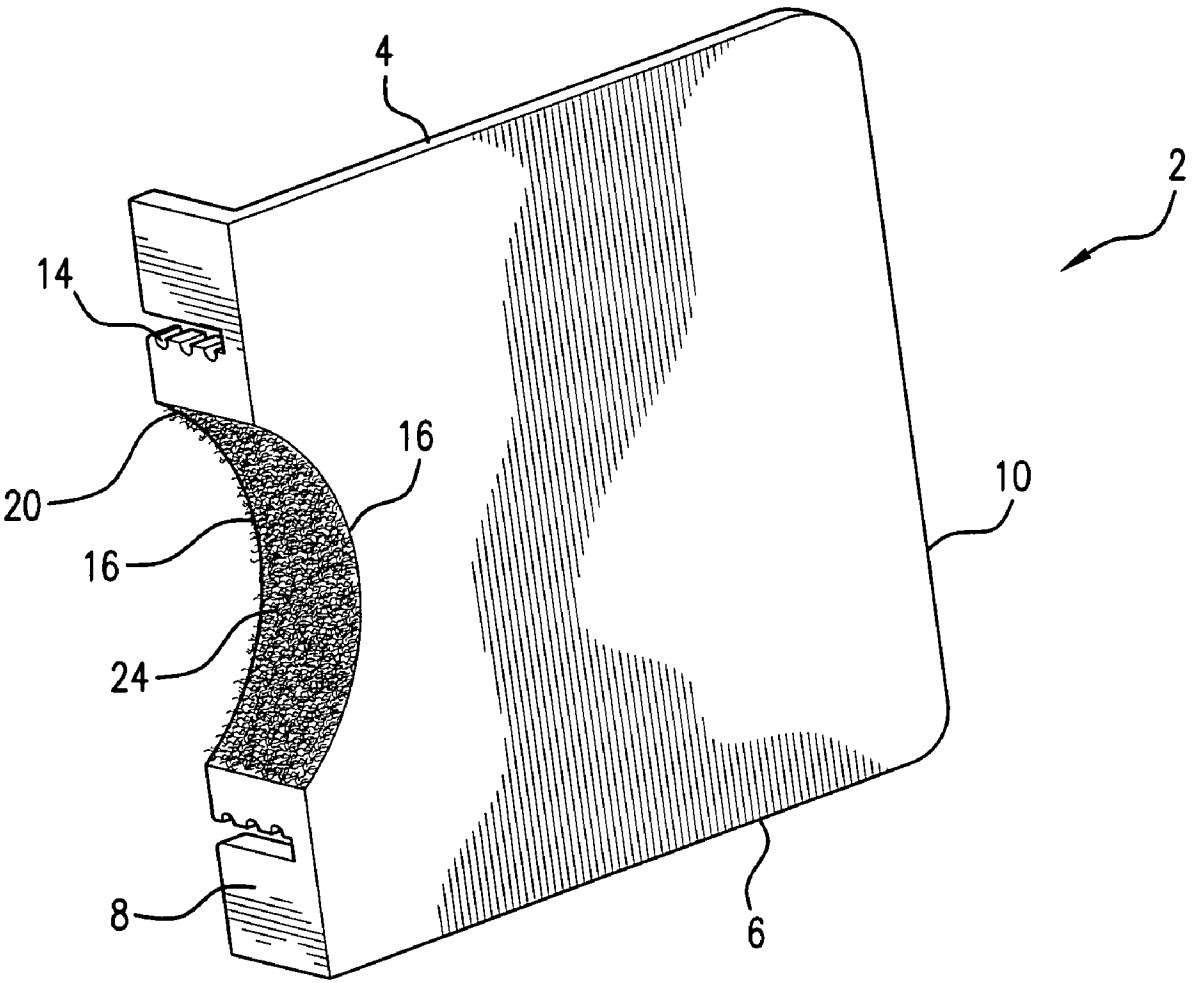
FIG. 3 is a full front view of the blocker plate.

FIG. 3 is a full front view of the blocker plate 2. This view is similar to FIG. 2; however, this view contains the channels 14 and their relationship to the Velcro 24 and the securing of the blocker plate 2 to the sight 12. The Velcro 24 is affixed to the inside surface 20 of the arcuate configuration 16. With Velcro 24 affixed to the sight 12 and meshing together and the O-rings wrapped around the sight 12 and in the channels 14 the blocker 2 is secured to the sight 12 for use.

Figure 4:
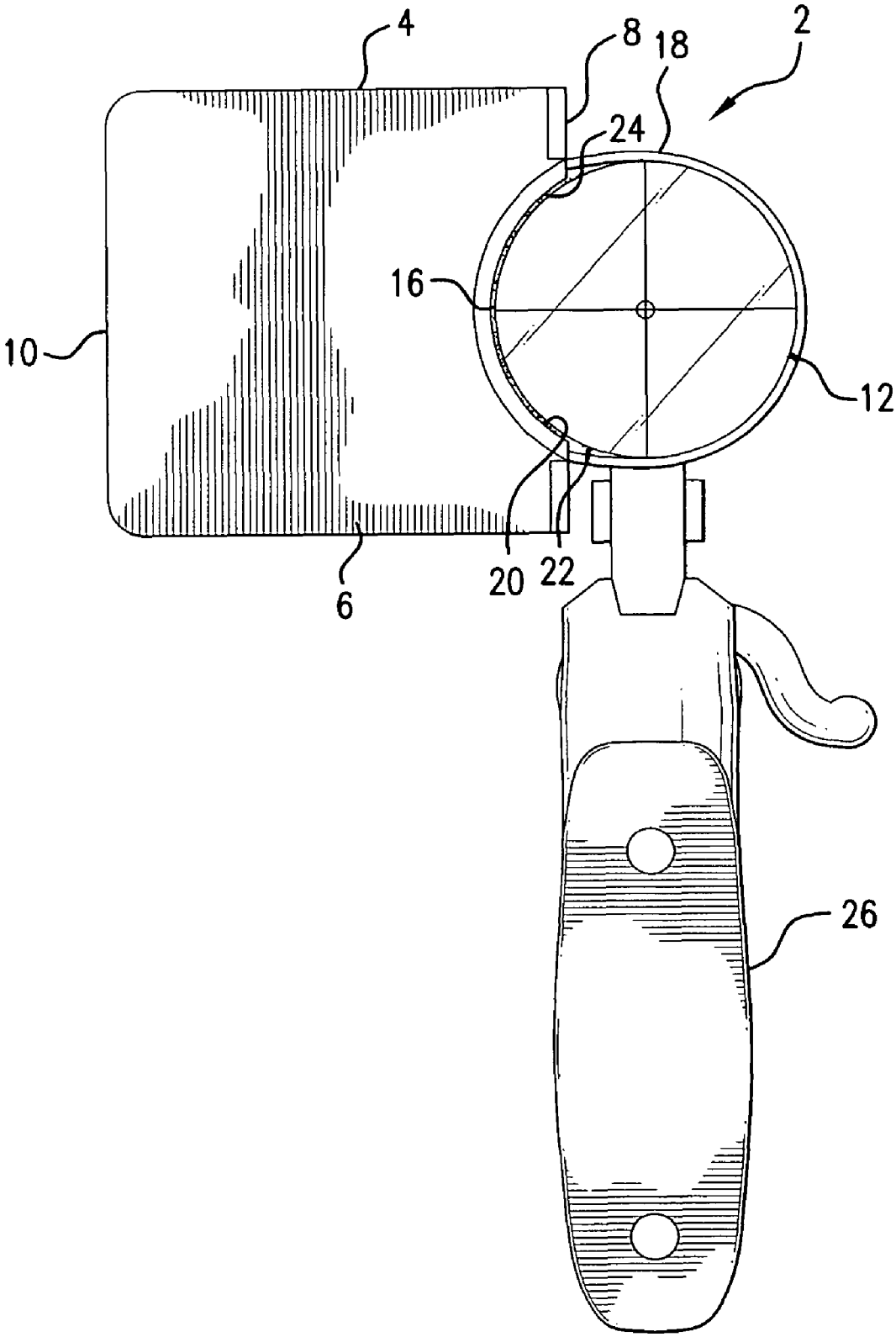
FIG. 4 is a full rear view of the accessory attached to a rifle scope.

FIG. 4 is a full rear view of the accessory attached to a rifle scope 12 that is mounted on a rifle 26. This view shows the relationship of the blocker 2 and its attachment of a rifle scope 12. The outside surface 22 of the scope 12 has the Velcro 24 attached to it. The inside surface 20 of the arcuate configuration 16 also has Velcro 24 attached to it. The blocker 2 is pressed against the sight 12 meshing the respective portions of the Velcro 24 securing the blocker 2 to the sight 12. Then the O-rings 18 are placed in the channels 14 of the arcuate configuration 16 and stretched around the outside surface 22 of the sight. The O-rings 18 provide additional attachment strength and stability during use. From this perspective it is clear that the user can look through the scope 12 with one eye and keep the other eye open during the sighting process preventing double vision that occurs if one eye is closed.

Figure 5:
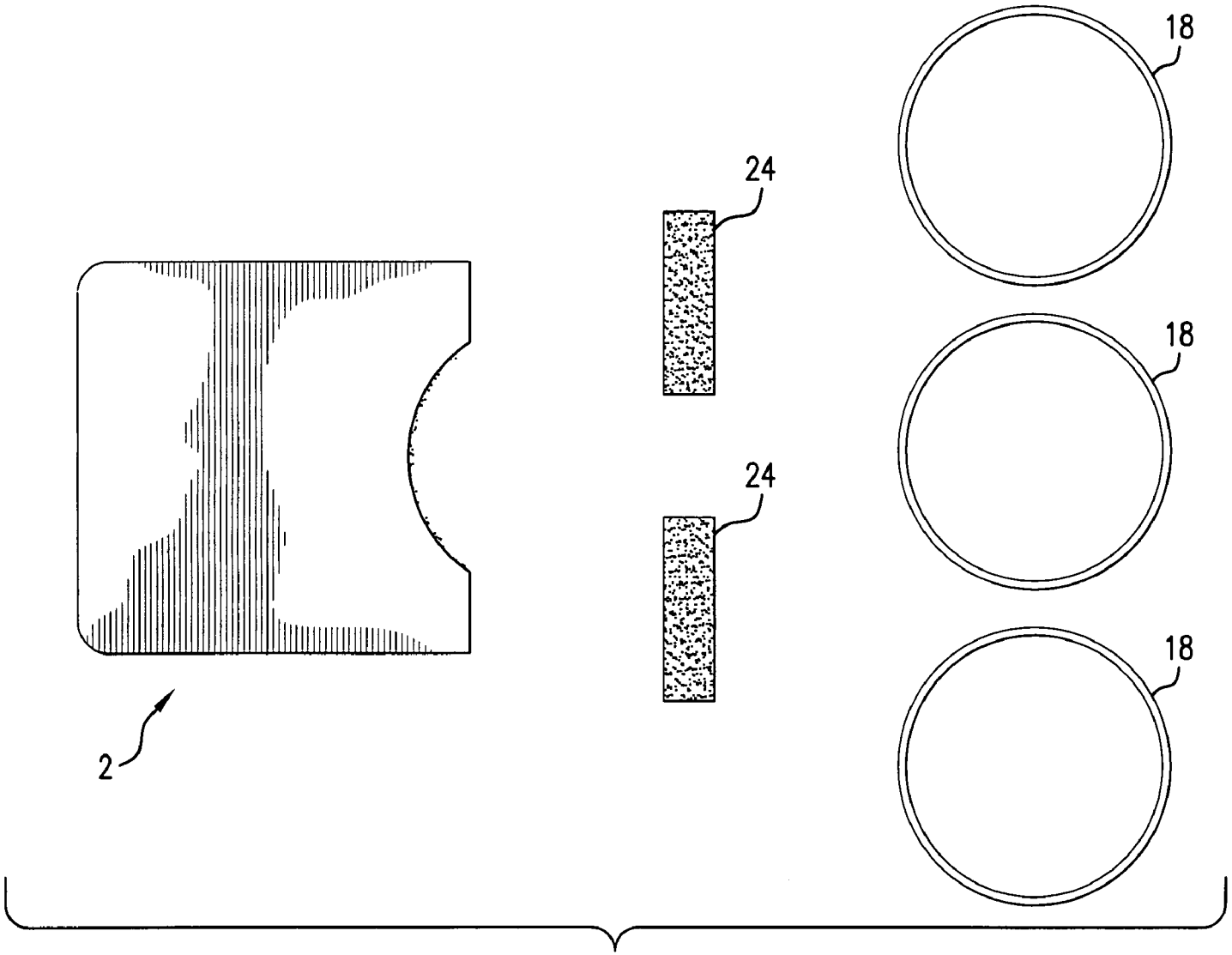
FIG. 5 is a sight accessory kit.

FIG. 5 is shows the component parts of the sight blocker 2 accessory kit; the blocker plate 2, Velcro 24 and O-rings 18. The loose Velcro 24 is placed on the outside surface 22 of the sight 12. The blocker plate 2 has Velcro 24 already affixed to the inside surface 20 of the arcuate configuration 16. These are meshed together and the O-rings 18 are applied securing the device 2 to the sight 12.

The main embodiment of the blocker 2 is for use on an archery bow sight 12. Other embodiments of this device include application to rifle scope 12 where the user again encounters the same problem and that is double vision from closing one eye to look through a scope 12 of a rifle. The application of the blocker plate 2 allows the user to keep both eyes open eliminating the development of double vision.

Other applications for use of the device 2 include a scope for a crossbow, a pistol scope, a shotgun scope, a spotting scope, survey equipment and telescopes.

What is claimed is:

1. A sight accessory comprising:

a blocker plate having a near end;

an arcuate attachment means near the near end of the blocker plate said arcuate attachment means having an outside surface and an inside surface and said outside surface having a plurality of channels therein;

an additional fastening means comprised of elastomeric O-rings that are contained in at least two of said channels that also have the capability of wrapping around an outside surface of a sight such that the blocker plate is located vertical and perpendicular to a long axis of the sight.

2. A sight accessory as claimed in claim 1 wherein, in addition, either a hook or loop fastener is affixed to the inside surface of the arcuate attachment means.

3. A sight accessory as claimed in claim 1 in combination with an archery bow sight.

4. A sight accessory as claimed in claim 1 in combination with a rifle scope.

5. A sight accessory as claimed in claim 1 in combination with a crossbow scope.

6. A sight accessory as claimed in claim 1 in combination with a pistol scope.

7. A sight accessory as claimed in claim 1 in combination with a shotgun scope.

8. A sight accessory as claimed in claim 1 in combination with a spotting scope.

9. A sight accessory as claimed in claim 1 in combination with a survey instrument.

10. A sight accessory as claimed in claim 1 in combination with a telescope.

11. A sight accessory as claimed in claim 1 in combination with a microscope.

* * * * *